United States Patent [19]

Ohtsu et al.

[11] Patent Number: 4,567,113

[45] Date of Patent: Jan. 28, 1986

[54] HEAT-SENSITIVE TRANSFERRING RECORDING MEDIUM

[75] Inventors: Tadatoshi Ohtsu, Hirakata; Takashi Yamahata, Koriyama, both of Japan

[73] Assignee: General Company Limited, Osaka, Japan

[21] Appl. No.: 647,753

[22] Filed: Sep. 6, 1984

[30] Foreign Application Priority Data

Sep. 12, 1983 [JP] Japan ..... 58-140207[U]
Oct. 3, 1983 [JP] Japan ..... 58-184652
Mar. 21, 1984 [JP] Japan ..... 59-52416

[51] Int. Cl.[4] ..... B41M 5/26

[52] U.S. Cl. ..... 428/480; 428/488.4; 428/704; 428/913; 428/914

[58] Field of Search ..... 427/146, 148; 428/206, 428/207, 480, 488.1, 488.4, 704, 913, 914

[56] References Cited

U.S. PATENT DOCUMENTS 4,275,106 6/1981 Watanabe ..... 428/207

*Primary Examiner*—Bruce H. Hess
*Attorney, Agent, or Firm*—Wegner & Bretschneider

[57] ABSTRACT

A heat-sensitive transferring recording medium comprises a base film, a heat melting ink layer provided on the under surface of the base film and a conveyance improving layer composed of a material selected from fatty acids, fatty acid derivatives, fatty alcohols, alkali metal salts of mono- or di-alkyl phosphoric acid esters of 8–18 carbon atoms, polyester copolymers, and other phosphoric acid esters.

12 Claims, 1 Drawing Figure

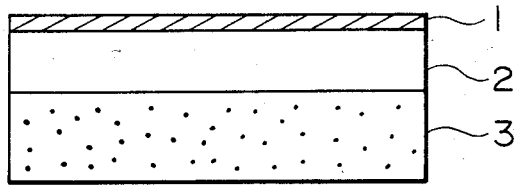
1
2
3

HEAT-SENSITIVE TRANSFERRING RECORDING MEDIUM

BACKGROUND OF THE INVENTION

1. Field of the Invention

This invention relates to a heat-sensitive transferring recording medium.

2. Description of the Prior Art

Heretofore, the conveyance property of heat-sensitive transferring recording media used in printers has been so poor that a part of a base film melts and sticks to a thermal head. Therefore, in order to improve the conveyance property, there have been used thermally crosslinking resins and thermosetting resins such as silicone resins, melamine resins and the like for a heat-sensitive member or a heat-sensitive transferring recording medium. However, these methods involve chemical reactions which complicate the procedures and require much labor. Furthermore, curling of the recording medium is easily caused.

SUMMARY OF THE INVENTION

An object of the present invention is to provide a heat-sensitive transferring recording medium free from the above-mentioned drawbacks.

Another object of the present invention is to provide a heat-sensitive transferring recording medium which does not stick to the thermal head of a printer, whose conveyance improving layer can be simply and easily formed, and which is free from curling.

According to the present invention, there is provided a heat-sensitive transferring recording medium which comprises a base film, a heat melting ink layer provided on the undersurface of the base film, and a conveyance improving layer provided on the upper surface of the base film, said conveyance improving layer comprising a member selected from the group consisting of (1) fatty acids, (2) fatty acid derivatives, (3) fatty alcohols, (4) alkali metal salts of mono-or di-alkyl phosphoric acid esters having 8–18 carbon atoms, (5) polyester copolymers having a molecular weight or 3000 or more prepared by polycondensation of (a) an aromatic dicarboxylic acid compound or an aliphatic dicarboxylic acid compound, (b) a diol having 2–4 carbon atoms, and (c) a polyethyleneglycol compound of a molecular weight of 2000 or more, (6) tri (polyoxyethylenealkyl or alkenyl ether) phosphoric acid esters of the formula,

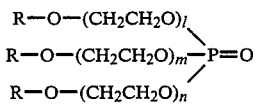

(I)

where R is alkyl or alkenyl of $C_8$–$C_{25}$, and l, m, and n are integers of 1–10, (7) phosphoric acid esters of the formula,

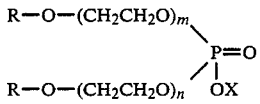

(II)

where R, m and n are as defined above and X is hydrogen or alkali metal, (8) phosphoric acid esters of the formula,

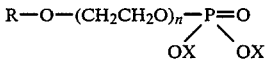

(III)

where R, n and X are as defined above, (9) phosphoric acid esters of the formula,

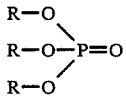

(IV)

where R is as defined above,

(10) phosphoric acid esters of the formula,

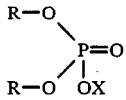

(V)

where R and X are as defined above, and

(11) phosphoric acid esters of the formula,

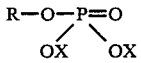

(VI)

where R and X are as defined above.

BRIEF DESCRIPTION OF THE DRAWING

The drawing schematically shows a cross-sectional view of an embodiment of the heat-sensitive transferring recording medium of the present invention.

DESCRIPTION OF THE PREFERRED EMBODIMENTS

As the base film, there may be used various known films such as polyester film, polycarbonate film, triacetylcellulose film, nylon film, cellophane and the like. The thickness of the film is, for example, 2–30μ.

Known heat melting ink layers may be used. For example, the heat melting ink layer may be produced by applying a mixture of a binder such as carnauba wax, beeswax and the like and a coloring agent to a base film by means of hot-melt coating, or by applying a liquid coating composed of a binder and a coloring agent dispersed in an appropriate solvent to a base film by means of solvent coating.

In addition to known heat melting ink layer, there may be used a new heat melting ink layer.

The new preferable heat melting ink layer is mainly composed of wax, a thermoplastic base polymer, an adhesivity imparting agent, and a coloring agent.

A heat melting ink layer can be formed by dispersing the above-mentioned ingredients in a solvent and applying the resulting mixture to a base film according to a solvent coating method, or by heat-melting the ingredients and applying the molten mixture to a base film according to a hot melt coating method.

As the wax, waxes having a melting point or softening point of 60°–110° C. are preferable. Examples of the wax are Japan wax, beeswax, ceresine wax, spermaceti, microcrystalline wax and the like.

As the thermoplastic base polymer, there may be used ethylene-vinyl acetate copolymers, polyamides, polyesters, synthetic rubber, ethylene-ethyl acrylate copolymer, atactic polypropylene, polyvinyl acetate and the like.

As the adhesivity imparting agent, there may be used rosin, its derivatives, terpene resins, hydrocarbon resins, low molecular weight styrene resins, coumarone-indene resins, and the like. The adhesivity imparting agent imparts a wetting property and a hot tack to a receiving paper or sheet.

As the coloring agent, there may be used various dyes or pigments ordinarily used in copying paper technology.

If desired, a plasticizer may be added.

Referring to the drawing, the heat-sensitive transferring recording medium comprises a base film 2, a heat melting ink layer 3 provided at the lower surface of the base film 2 and a conveyance improving layer 1 provided on the upper surface of the base film 2.

Typical fatty acids used for the conveyance improving layer are, for example, fatty acids having 12 or more carbon atoms such as lauric acid, myristic acid, margaric acid, stearic acid, montanic acid and the like.

As the fatty acid derivatives used for the conveyance improving layer, there may be mentioned metal salts of fatty acids and fatty acid esters. Typical metal salts of fatty acids are, for example, sodium, barium, lithium and silver salts of straight chain fatty acids of $C_8$–$C_{18}$ such as caprylic acid, lauric acid, myristic acid, palmitic acid, stearic acid and the like, copper and calcium salts of straight chain fatty acids of $C_8$–$C_{10}$ such as caprylic acid, pelargonic acid, capric acid and the like, and aluminum mono-, di- or tristearate. Typical fatty acid esters are, for example, glyceryl 1-monostearate, glyceryl 1,3-distearate, glyceryl tristearate and the like.

As fatty alcohols used for the conveyance improving layer, there may be mentioned lauryl alcohol, myristyl alcohol, cetyl alcohol, stearyl alcohol, oleyl alcohol and the like.

The conveyance improving layer may be formed by, for example, dissolving the fatty acid, fatty acid derivative or fatty alcohol in an appropriate solvent such as methanol and applying the resulting solution to a base film, for example, in an amount of about 0.3–3 g/m$^2$ (as solid matter) according to a solvent coating process.

As the alkali metal salts of mono- or di-alkyl phosphoric acid esters having 8–18 carbon atoms used for the conveyance improving layer, there may be mentioned, for example, alkali metal salts such as lithium, sodium, potassium salts and the like of mono- or di-higher alkyl, or alkenyl esters such as lauryl, cetyl, stearyl, oleyl esters and the like of phosphoric acid.

As the polyester copolymers having a molecular weight of 3000 or more prepared by polycondensation of (a) an aromatic dicarboxylic acid compound or an aliphatic dicarboxylic acid compound, (b) a diol having 2–4 carbon atoms, and (c) a polyethyleneglycol compound of a molecular weight of 2000 or more, there may be used the following polyester copolymers.

Typical aromatic dicarboxylic acid compounds are terephthalic acid, isophthalic acid, phthalic acid, 2,6-naphthalene-dicarboxylic acid and the like and esters thereof such as dialkyl esters of terephthalic acid and the like.

Typical aliphatic acid compounds are sebacic acid and the like and esters thereof.

Typical diols are ethylene glycol, diethylene glycol, propylene glycol, butane diol, and the like.

Typical polyethylene glycol compounds of a molecular weight of 2000 or more are polyethylene glycol, monoethers of polyethylene glycol such as higher alcohol monoether, monophenyl ether of polyethylene glycol and the like, and monoesters of polyethylene glycol such as higher fatty acid monoesters or monophenyl esters of polyethylene glycol.

The dicarboxylic acids may be used alone or in combination. For example, a dialkyl ester of terephthalic acid is used as a main component and a small amount of isophthalic acid, phthalic acid, 2,6-naphthalene-dicarboxylic acid, sebacic acid or ester thereof is added to the main component.

Each of the aromatic dicarboxylic acid compound, the aliphatic dicarboxylic acid compound and the diol may be used alone or in combination, and one of them may be used alone while the other may be used in combination.

The conveyance improving layer may be formed, for example, in an amount of 0.1–5 g/m$^2$ (as solid matter) by coating.

As to the compound of (6), Formula (I) above, alkyl and alkenyl of the tri(polyoxyethylenealkyl or alkenyl ether) phosphoric acid esters have usually 8–25 carbon atoms, preferably 12–18 carbon atoms and are of straight chain or branched, and the addition mole number of ethylene oxide, i.e., l. m or n, is usually 1–10, preferably 1–6.

Representative tri(polyoxyethylenealkyl or alkenyl ether) phosphoric acid esters are tri(polyoxyethylene) lauryl ether phosphoric acid esters (l, m, n=2), tri(polyoxyethylene)lauryl ether phosphoric acid esters (l, m, n=4), tri(polyoxyethylene)stearyl ether phosphoric acid esters (l, m, n=3), tri(polyoxyethylene) stearyl ether phosphoric acid esters (l, m, n=5), tri(polyoxyethylene)oleyl ether phosphoric acid esters (l, m, n=4), and the like.

Representative phosphoric acid esters of (7), Formula (II), are potassium di(polyoxyethylene) cetyl ether phosphate (m, n=5), sodium di(polyoxyethylene)cetyl ether phosphate (m, n=5), sodium di(polyoxyethylene)-lauryl ether phosphate (m, n=3), potassium di(polyoxyethylene)lauryl ether phosphate (m, n=3), and the like.

Representative phosphoric acid esters of (8), Formula (III), are dipotassium mono(polyoxyethylene) lauryl ether phosphate (n=3), disodium mono(polyoxyethylene)lauryl ether phosphate (n=3), dipatassium mono(polyoxyethylene)cetyl ether phosphate (n=5), disodium mono(polyoxyethylene)cetyl ether phosphate (n=5) and the like.

Representative phosphoric acid esters of (9), Formula (IV), are tristearyl phosphate, trilauryl phosphate, tricetyl phosphate and the like.

Representative phosphoric acid esters of (10), Formula (V), are potassium distearyl phosphate, sodium dilauryl phosphate, potassium dicetyl phosphate and the like.

Representative phosphoric acid esters of (11), Formula (VI), are dipotassium monostearyl phosphate, disodium monostearyl phosphate, dipotassium monolauryl phosphate, disodium monolauryl phosphate, dipotassium monocetyl phosphate and the like.

The conveyance improving layer may be formed, for example, in an amount of 0.1-5 g/m$^2$ (as solid matter) by coating a compound of (6)-(11) as mentioned above.

EXAMPLE 1

A known heat melting ink was applied to the under surface of a polyester film of 3$\mu$ thick. To the upper surface of the polyester film was applied a coating composed of 1000 ml of a heated methanol and 25 g of sodium stearate in an amount of 0.5 g/m$^2$ to form a conveyance improving layer.

The resulting heat-sensitive transferring recording medium was subjected to a printing operation by using P6 printer (tradename, manufactured by Fuji Xerox Co., Japan). No sticking of the recording medium to the thermal head, was caused and the printing was smoothly effected. Furthermore no curling of the recording medium occurred and the recording medium was able to be easily loaded in a printing machine.

When the conveyance improving layer was not formed, sticking of the recording medium to the thermal head was caused, and the resulting printed letters were not sharp.

EXAMPLE 2

The procedure of Example 1 was repeated except that a coating produced by mixing 2 parts by weight of aluminum distearate and 98 parts by weight of ethanol and heating to 50° C. was used in place of the coating in Example 1. The coating amount was 1 g/m$^2$. The resulting heat-sensitive transferring recording medium was subjected to a printing operation by using P6 printer (tradename, manufactured by Fuji Xerox Co., Japan). A good result as in Example 1 was obtained.

EXAMPLE 3

To the lower surface of a polyester film of 3$\mu$ thick was applied a mixture produced by mixing 30 parts by weight of carnauba wax, 35 parts by weight of ester wax, 25 parts by weight of a pigment and 10 parts by weight of an oil by using a heated roll mill to form a heat melting ink layer. Then, to the upper surface of the polyester film was applied a 3% aqueous solution of potassium lauryl phosphate (a mixture of monoester which diester) and dried to form a coating of about 0.2 g/m$^2$.

The resulting heat-sensitive transferring recording medium was subjected to printing by using P6 printer (tradename, manufactured by Fuji Xerox Co., Japan). The conveyance property was excellent. There was no sticking of the recording medium to the thermal head, and, printing was smoothly effected. In addition, the recording medium did not suffer from curling and was easily loaded in a printing machine.

When the conveyance improving layer was not formed, the conveyance property was so poor that sticking of the recording medium to the thermal head occurred and the printed letters were not sharp.

EXAMPLE 4

Repeating the procedure of Example 3 except that a 2% emulsion of a polyester copolymer having a molecular weight of about 5000 prepared by condensation of 150 parts by weight of dimethyl terephthalate, 41 parts by weight of ethyleneglycol, and polyethyleneglycol monophenyl ether having a molecular weight of 3000 was used in place of potassium lauryl phosphate, there was obtained a conveyance improving layer 0.1 g/m$^2$.

Print testing was conducted following the procedure as in Example 3. The result was as good as that in Example 3.

EXAMPLE 5

To the lower surface of a polyester film of 3$\mu$ thick was applied a mixture produced by mixing 30 parts by weight of carnauba wax, 35 parts by weight of ester wax, 25 parts by weight of a pigment and 10 parts by weight of an oil by using a heated roll mill to form a heat melting ink layer. Then, to the upper surface of the polyester film was applied a 3% aqueous solution of a mixture of potassium di(polyoxyethylene) lauryl ether phosphate (m, n=3) and dipotassium mono(polyoxyethylene) lauryl ether phosphate (n=3) (weight ratio of 1:1) which dried to form a coating of about 0.2 g/m$^2$.

The resulting heat-sensitive transferring recording medium was subjected to printing by using P6 printer (tradename, manufactured by Fuji Xerox Co., Japan). The conveyance property was excellent. There was no sticking of the recording medium to the thermal head, and, printing was smoothly effected. In addition, the recording medium did not suffer from curling and was able to be easily loaded in a printing machine.

When the conveyance improving layer was not formed, the conveyance property was so poor that sticking of the recording medium to the thermal head occurred and the printed letters were not sharp.

EXAMPLE 6

Repeating the procedure of Example 5 except that a 3% aqueous solution of tri(polyoxyethylene) stearyl ether phosphoric acid ester (l, m, n=5) was used in place of potassium polyoxyethylene lauryl ether phosphate, there was obtained a conveyance improving layer of 0.1 g/m$^2$.

Print testing was carried out following the procedure as in Example 5, and the result was as good as that in Example 5.

EXAMPLE 7

Repeating the procedure of Example 5 except that an equeous solution of tri(polyoxyetnylene) stearyl ether phosphoric acid (l, m, n=5), disodium monolauryl phosphate and sodium dilauryl phosphate (weight ratio of 1:1:1) was used in place of potassium polyoxyethylene lauryl ether phosphate, there was produced a conveyance improving layer of 0.1 g/m$^2$.

Print testing was effected following the procedure of Example 5 to obtain as good a result as in Example 5.

EXAMPLE 8

Repeating the procedure of Example 5 except that an aqueous solution of tri(polyoxyethylene) lauryl ether phosphoric acid ester (l, m, n=4) and trilauryl phosphate (weight ratio of 1:1) was used in place of the mixture of the potassium polyoxyethylene lauryl ether phosphates, there was obtained a conveyance improving layer of 0.1 g/m$^2$.

Print testing was carried out following the procedure as in Example 5, and the result was as good as that in Example 5.

EXAMPLE 9

The procedure of Example 1 was repeated except that a heat melting ink layer was formed by applying the following composition:

| | |
|---|---|
| Microcrystalline wax | 20 parts by weight |
| Ethylene-vinyl acetate copolymer ("Everlite", tradename, supplied by Sumitomo Kagaku Kogyo K.K.) | 5 parts by weight |
| Low molecular weight styrene resin ("Himer ST-95" tradename supplied by Sanyo Kasei K.K.) | 10 parts by weight |
| Carbon black ("MA-10", tradename, supplied by Mitsubishi Kasei K.K.) | 20 parts by weight |
| Toluene | 45 parts by weight |
| | 100 parts by weight |

to the base film, according to a solvent coating method, in the thickness of 4μ(as solid matter).

The resulting heat-sensitive transferring recording medium was tested for the printing characteristics by using P6 printer (tradename, manufactured by Fuji Xerox Co., Japan). No sticking of the recording medium to the thermal head occured, and the printing was smoothly effected. No curling of the recording medium occured, and the recording medium was able to be easily loaded in a printing machine. In addition, the resolution was good and the transferring property was improved.

EXAMPLE 10

The procedure of Example 9 was repeated except that a heat melting ink layer was formed by applying the following composition:

| | |
|---|---|
| Carnauba wax | 30 parts by weight |
| Paraffin wax | 20 parts by weight |
| Wax oxide | 15 parts by weight |
| Ethylene-vinyl acetate copolymer | 5 parts by weight |
| Terpene resin | 10 parts by weight |
| Carbon black | 20 parts by weight |
| | 100 parts by weight |

The results were similar to those in Example 9.

We claim:

1. A heat-sensitive transferring recording medium which comprises a base film, a heat melting ink layer provided on the under surface of the base film, and a conveyance improving layer provided on the upper surface of the base film, said conveyance improving layer comprising a member selected from the group consisting of (1) fatty acids, (2) fatty acid derivatives, (3) fatty alcohols, (4) alkali metal salts of mono- or di-alkyl phosphoric acid esters having 8–18 carbon atoms, (5) polyester copolymers having a molecular weight of 3000 or more prepared by polycondensation of (a) an aromatic dicarboxylic acid compound or an aliphatic dicarboxylic acid compound, (b) a diol having 2–4 carbon atoms, and (c) a polyethyleneglycol compound of a molecular weight of 2000 or more, (6) tri(polyoxyethylenealkyl or alkenyl ether) phosphoric acid esters of the formula,

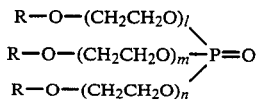

(I)

where R is alkyl or alkenyl of $C_8$–$C_{25}$, and l m, and n are integers of 1–10, (7) phosphoric acid esters of the formula,

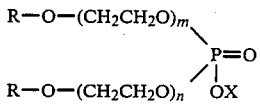

(II)

where R, m and n are as defined above and X is hydrogen or alkali metal, (8) phosphoric acid esters of the formula,

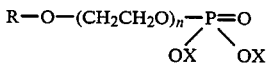

(III)

where R, n and X are as defined above, (9) phosphoric acid esters of the formula,

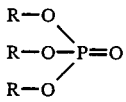

(IV)

where R is as defined above,

(10) phosphoric acid esters of the formula,

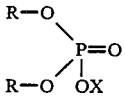

(V)

where R and X are as defined above, and

(11) phosphoric acid esters of the formula,

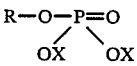

(VI)

where R and X are as defined above.

2. A heat-sensitive transferring recording medium according to claim 1 in which the conveyance improving layer comprises a fatty acid derivative which is a metal salt of a fatty acid.

3. A heat-sensitive transferring recording medium according to claim 2 in which the metal salt of a fatty acid is selected from the group consisting of the sodium, barium, lithium and silver salts of straight chain fatty acids of $C_8$–$C_{18}$ and copper and calcium salts of straight chain fatty acids of $C_8$–$C_{10}$.

4. A heat-sensitive transferring recording medium according to claim 2 in which the metal salt of fatty acid is aluminum tristearate.

5. A heat-sensitive transferring recording medium according to claim 1 in which the conveyance improving layer comprises a fatty acid derivative which is a fatty acid ester.

6. A heat-sensitive transferring recording medium according to claim 1 in which the conveyance improving layer comprises the polyester copolymer (5) in which the dicarboxylic acid compound (5) (*a*) is aromatic and selected from the group consisting of terephthalic acid, isophthalic acid, phthalic acid, 2,6-naphthalene dicarboxylic acid and esters thereof.

7. A heat-sensitive transferring recording medium according to claim 1 in which the conveyance improving layer comprises the polyester copolymer (5) in which the dicarboxylic acid (5) (*a*) is aliphatic and selected from the group consisting of sebacic acid and esters thereof.

8. A heat-sensitive transferring recording medium according to claim 1 in which the conveyance improving layer comprises the polyester copolymer (5) in which the diol (5) (*b*) is selected from the group consisting of ethylene glycol, diethylene glycol, propylene glycol, or butanediol.

9. A heat-sensitive transferring recording medium according to claim 1 in which the conveyance improving layer comprises the polyester copolymer (5) in which the polyethylene glycol compound of a molecular weight of 2000 or more (5) (*c*) is selected from the group consisting of polyethylene glycol, monoether thereof and monoester thereof.

10. A heat-sensitive transferring recording medium according to claim 9 in which the monoester is selected from the group consisting of a higher fatty acid monoester and monophenyl ester of polyethylene glycol.

11. A heat-sensitive transferring recording medium according to claim 9 in which the monoether is selected from the group consisting of a higher alcohol monoether and a monophenyl ether of polyethylene glycol.

12. A heat-sensitive transferring recording medium according to claim 1 in which the heat melting ink layer consists essentially of wax, a thermoplastic base polymer, an adhesivity imparting agent and a coloring agent.

* * * * *